US008002031B2

(12) United States Patent
De Kimpe et al.

(10) Patent No.: US 8,002,031 B2
(45) Date of Patent: Aug. 23, 2011

(54) INDEPENDENT MEASURING AND PROCESSING PROBE FOR PRELIMINARY STUDIES ON A WELL

(75) Inventors: Thierry De Kimpe, Gommerville (FR); Jean-Eric Negre, Verrieres le Buisson (FR); Jean Czernichow, Chatenay-Malabry (FR)

(73) Assignee: Sercel, Carquefou (FR)

( * ) Notice: Subject to any disclaimer, the term of this patent is extended or adjusted under 35 U.S.C. 154(b) by 121 days.

(21) Appl. No.: 11/347,058

(22) Filed: Feb. 2, 2006

(65) Prior Publication Data

US 2006/0180303 A1 Aug. 17, 2006

(30) Foreign Application Priority Data

Feb. 4, 2005 (FR) ..... 05 01131

(51) Int. Cl.
*E21B 47/00* (2006.01)

(52) U.S. Cl. ..... 166/250.01; 166/250.11; 166/113; 166/213; 73/152.52; 73/152.58; 181/105

(58) Field of Classification Search ..... 166/250.01, 166/250.07, 66, 113, 213, 250.11; 73/152.52, 73/152.58; 175/325.1–325.7; 367/35; 181/104, 181/105

See application file for complete search history.

(56) References Cited

U.S. PATENT DOCUMENTS

| | | | | |
|---|---|---|---|---|
| 2,832,421 | A * | 4/1958 | Baker | 166/213 |
| 4,757,873 | A | 7/1988 | Linyaev et al. | |
| 5,092,423 | A | 3/1992 | Petermann | |
| 5,181,565 | A * | 1/1993 | Czernichow | 166/66 |
| 5,265,680 | A * | 11/1993 | Withers et al. | 166/380 |
| 5,801,642 | A | 9/1998 | Meynier | |
| 5,810,080 | A * | 9/1998 | Meynier | 166/66 |
| 2004/0011559 | A1 | 1/2004 | Harvey et al. | |
| 2004/0163807 | A1 | 8/2004 | Vercaemer | |
| 2004/0251048 | A1 * | 12/2004 | Kurkoski | 175/41 |
| 2008/0125760 | A1 * | 5/2008 | Gilboa | 604/892.1 |

FOREIGN PATENT DOCUMENTS

EP 0 303 536 A1 2/1989

* cited by examiner

*Primary Examiner* — David J Bagnell
*Assistant Examiner* — Sean Andrish
(74) *Attorney, Agent, or Firm* — Blakely, Sokoloff, Taylor & Zafman

(57) ABSTRACT

The invention concerns an independent measuring and processing probe designed to be lowered in a tube for temporarily installation at the bottom of a hydrocarbon well.

Figure 1:
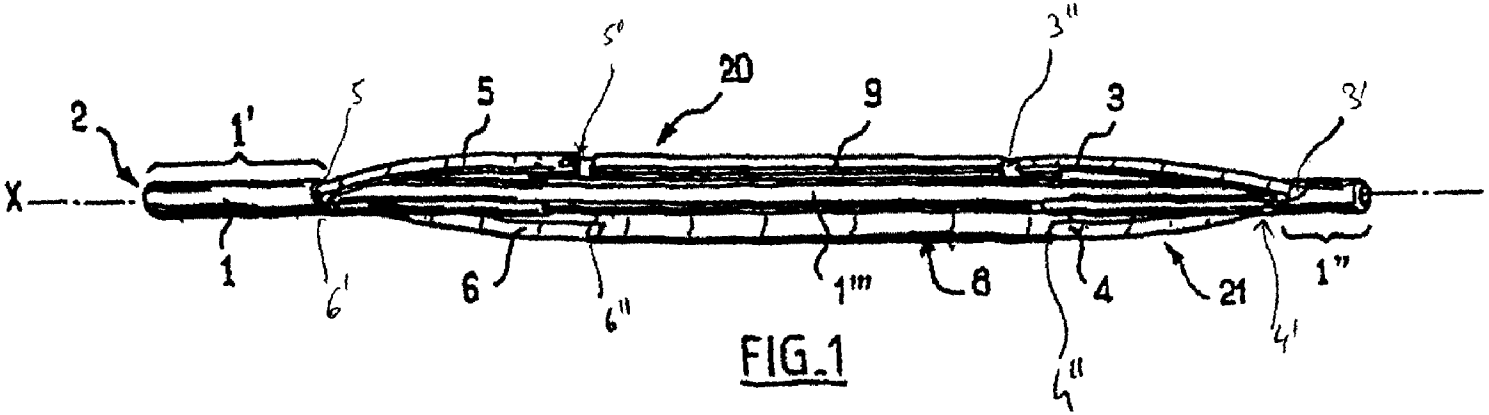

It includes removable anchoring resources (3, 4) capable of anchoring the probe to a casing at the bottom of the well, a set of sensors, at least one of which is a seismic sensor, recording resources, resources for processing the measurements provided by the sensors, and a central body (1) integrally reamed throughout the whole of its length by an opening (2) so as to allow free passage through the probe when it is in the anchored position.

Such a probe can be used in particular to effect a reliable preliminary study on the well before installing a more complete observation system.

11 Claims, 5 Drawing Sheets

INDEPENDENT MEASURING AND PROCESSING PROBE FOR PRELIMINARY STUDIES ON A WELL

This present invention concerns a probe designed to be lowered to the bottom of a well, and in particular a well in a crude-oil or gas reservoir.

More particularly, the invention concerns an independent measuring probe, designed to be lowered in a tube to be installed temporarily at the bottom of the well.

It is recognised that the operation of a reservoir of hydrocarbons represents considerable risks for an operator, in particular in financial terms.

In fact, the quantity of hydrocarbons that can be brought to the surface in relation to the total quantity contained in the reservoir depends on the geology of the well and on the production technique.

As a consequence, it is generally desirable to have better knowledge of the geology and morphology of the reservoir, and the movements of the different fluids (water, gas, and crude oil) contained in the reservoir during production.

By way of example, such knowledge enables us to improve the extraction yield of hydrocarbons from the reservoir.

In this regard, with the aim of gaining better knowledge of the reservoir, it is common to measure parameters like the resistivity, the porosity, and the permeability in an exploration well, in order to ascertain in particular whether the reservoir contains gas or crude-oil, and in the affirmative, in what quantity.

Furthermore, another question to which one would generally like an answer is whether the gas or the crude-oil present in the reservoir can be extracted easily.

As mentioned previously, optimisation of the production is a very important element in the operation of the reservoir.

As an example, if it is possible to extract just a few extra percent of hydrocarbons, not only does the profitability of the operation increase but the quantity of the usable hydrocarbon reserves increases too.

One technique which can be used to improve the rate of retrieval of the hydrocarbons consists, amongst others, of injecting a fluid under pressure into the reservoir so as to fracture the reservoir rock, and thus enable a more effective draining of the hydrocarbons toward the production well.

In addition, during production of the hydrocarbons, it is important to know the manner in which the fluids are moving, so as to verify that certain zones of the reservoir do not remain isolated and that the drainage is homogeneous and optimal.

To this end, a known technique consists of lowering measuring instruments attached to the outside of the tube (in order not to hinder production) in order to monitor the quality of hydraulic fracturing intended for the drainage system, and then to identify the movements of the different fluids present in the reservoir, using acoustic emissions generated by these movements.

Another known technique consists of using an observation well, in order to allow similar measurements to be taken without impeding production.

However, these very effective techniques remain complex and costly to implement.

One objective of the invention is to enable the execution of a preliminary study in a zone, in order to characterise, over a short period, the usefulness of a permanent installation of measuring instruments, and in particular to allow the characterisation of a hydraulic fracturing exercise.

In order to meet such an objective, the invention proposes an independent measuring and processing probe, to be installed and then temporarily abandoned at the bottom of the well, below the tube for example.

Its installation requires no major logistics, and it is not necessary to maintain any line link to the surface. More precisely, the invention concerns an independent measuring and processing probe designed to be lowered in a tube, and to be installed temporarily at the bottom of a well, wherein it includes:

- removable anchoring resources capable of anchoring the probe to a casing at the bottom of the well,
- a set of sensors, at least one of which is a seismic sensor,
- recording resources,
- resources for processing the measurements provided by the sensors, and
- a central body reamed throughout the whole of its length by an opening so as to allow free passage through the probe when it is in the anchored position.

Preferred though not limiting aspects of this probe are as follows:

- a longitudinal part of the central body is in the form of a U-shaped channel, defining an empty space which corresponds to part of the passage opening when the probe is anchored, and used to accommodate the sensors, the recording resources, and the measuring resources when the probe is closed;
- the probe includes two anchoring resources, each with two bowed elastic blades, one being connected to a sliding element located at one end of the probe, and the other being connected to the central body of the probe at the opposite end of the latter;
- the sliding element slides in relation to the central body of the probe, along the X axis, so that the anchoring resources are subjected to forces which cause them to move away from or toward the central body, according to the direction of motion of the sliding element;
- one of the anchoring resources supports the sensors, the recording resources and the processing resources;
- the central body has a recess so that the probe can be temporarily grasped by a fitting tool or a coiled tube;
- the probe also includes a communication resource;
- the communication resource is suitable for communicating in particular with the fitting tool or the coiled tube;
- the set of sensors includes at least one pressure sensor and at least one temperature sensor;
- the sensor designed to be capable of executing the seismic measurements is composed of geophones and/or accelerometers and/or hydrophones;
- an upper end of the central body is shaped so that it can be placed in a lower end of the tube, in particular when the probe is anchored to the casing;
- the recording resources include at least one data memory;
- the processing resources consist, in particular, of a digital data processor;
- the memory contains data relating in particular:
  - to the measurements coming from the sensors,
  - to algorithms which, together with the processor, are capable of processing these measurements, and
  - to the results obtained after the execution, by the processor, of at least one of these processes;
- the communication resources are capable of downloading algorithms from the fitting probe to at least one of the memories of the probe;

Another goal of the invention is the use of this probe to monitor hydraulic fracturing in a well, in particular of the hydrocarbon type.

Thus, one advantage of the invention is that its installation is relatively simple to implement.

And because of this, this probe being independent, it may be abandoned easily at the bottom of the well for a selected period, and then retrieved, and repeat this as often as necessary.

Furthermore, one advantage associated with the fact that it can be abandoned is that the well is no longer encumbered by the inconvenience of cables connecting it to the surface.

And thus, the passage of an additional instrument into the well is very much facilitated.

Another advantage is that this probe is arranged so as to be able to implement operations which are typical of the operation of the well, despite its presence.

In this regard, the probe of the invention is particularly designed so that hydraulic fracturing can be carried out in the well.

It is possible even to envisage the use of this probe to monitor such a fracturing process.

To this end, the measurement of data coming from the sensors of the probe in particular allows the conditions in which the fracturing process is taking place to be analysed, and to be adapted if necessary.

The invention also provides an advantage in financial terms.

By way of a non-limited example, using the probe, it is possible to achieve a first seismic analysis of a well that is installed but with no measuring instruments.

This therefore avoids the considerable cost engendered, for example, by the removal of the tube, the installation of the instruments in it, and then the re-fitting of the tube in the well.

Figure 2:
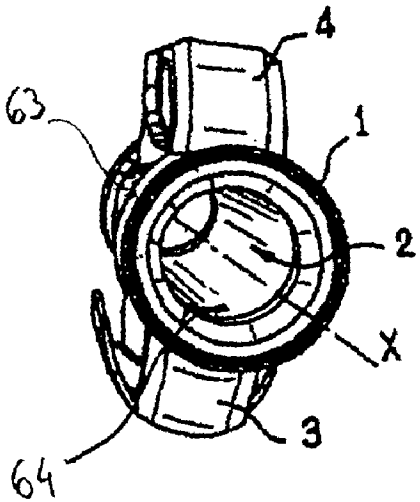
Figure 3:
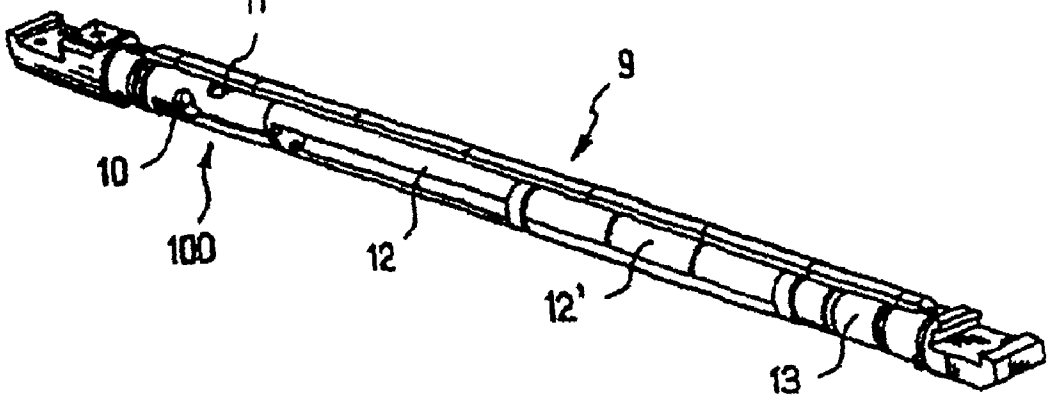
Figure 5:
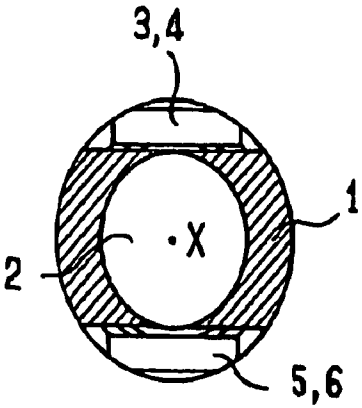
Figure 4:
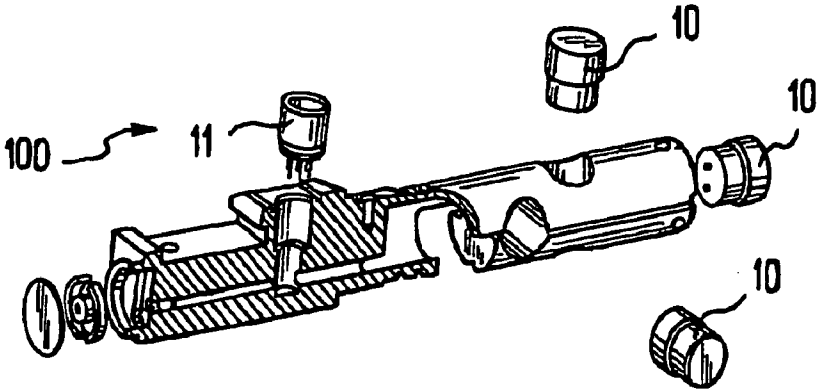
Figure 6A:
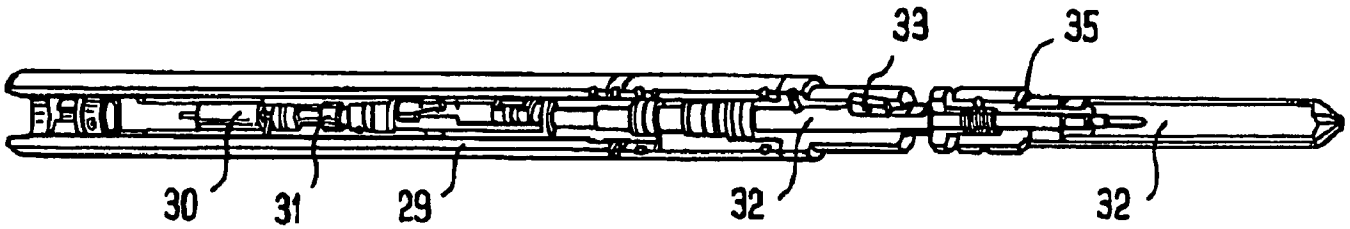
Figure 6B:
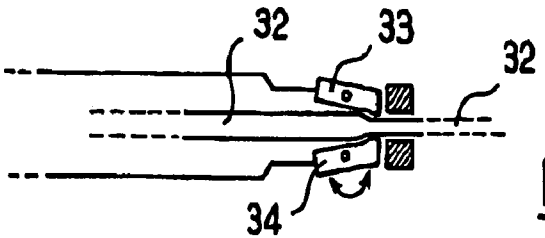
Figure 7:
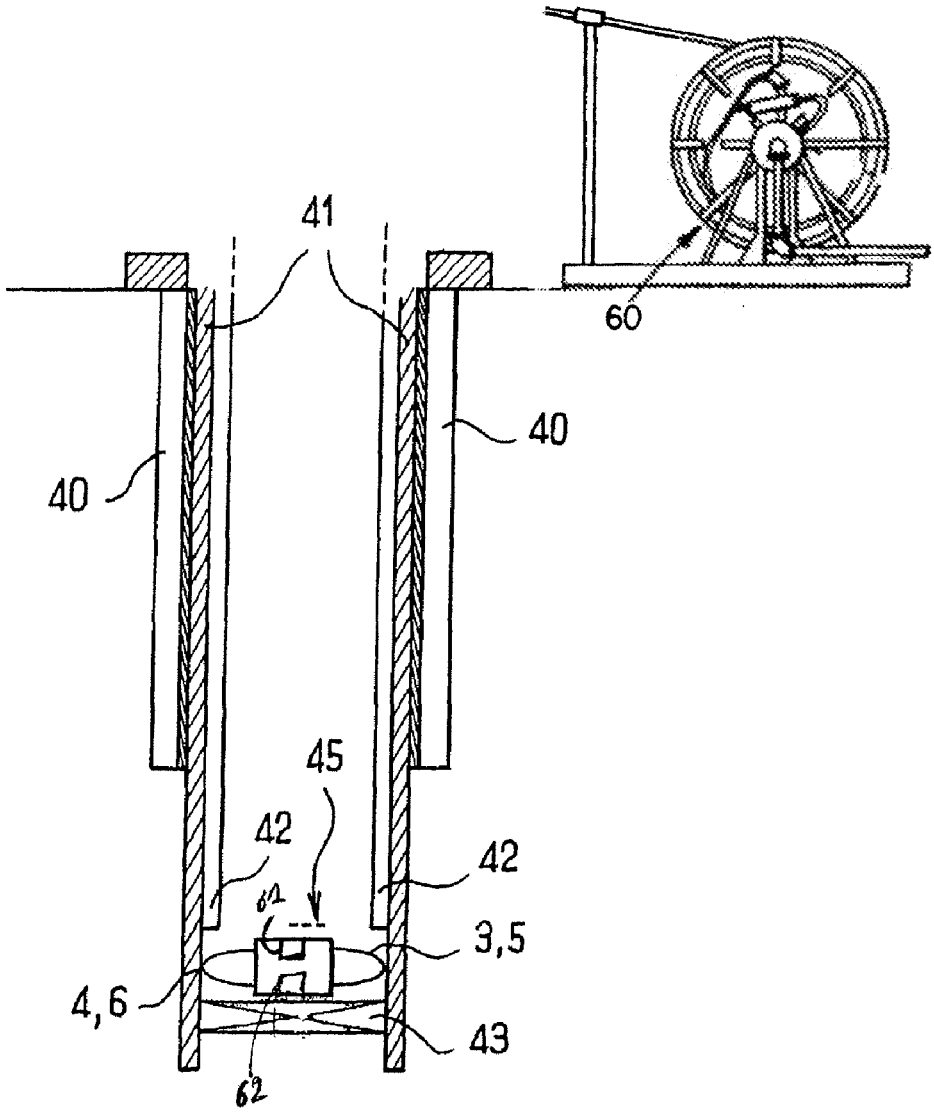
Figure 8A:
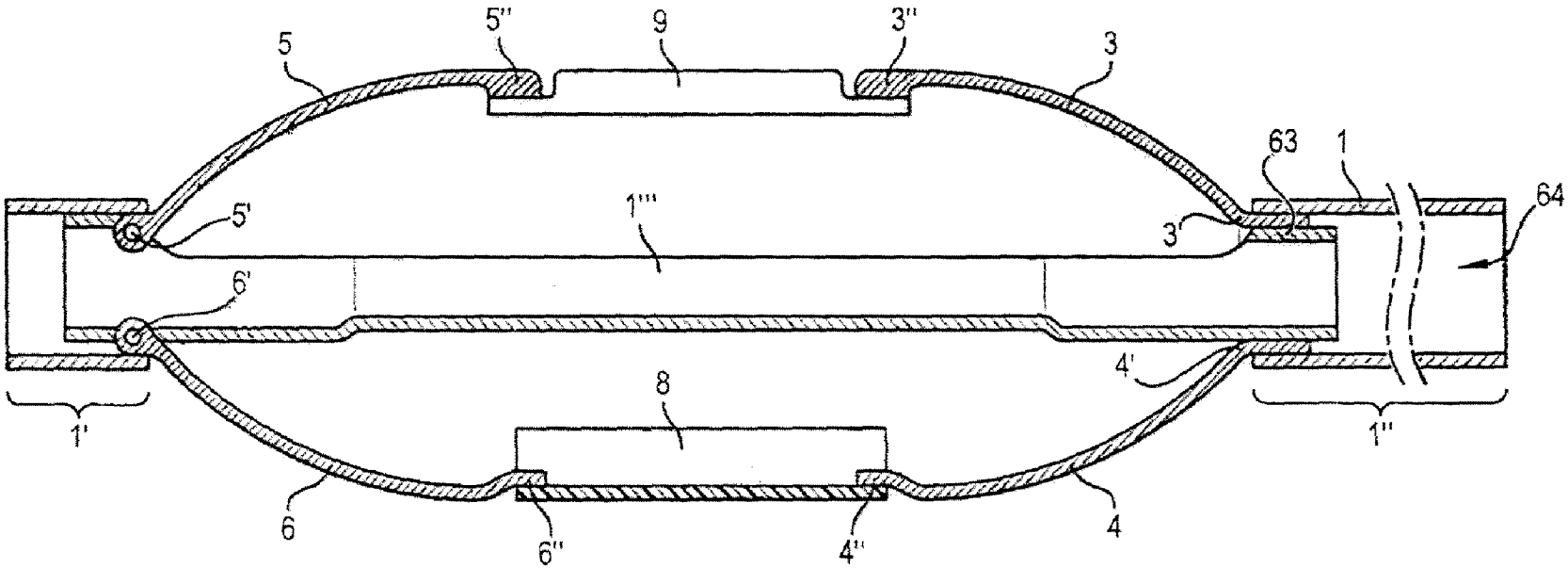
Figure 8B:
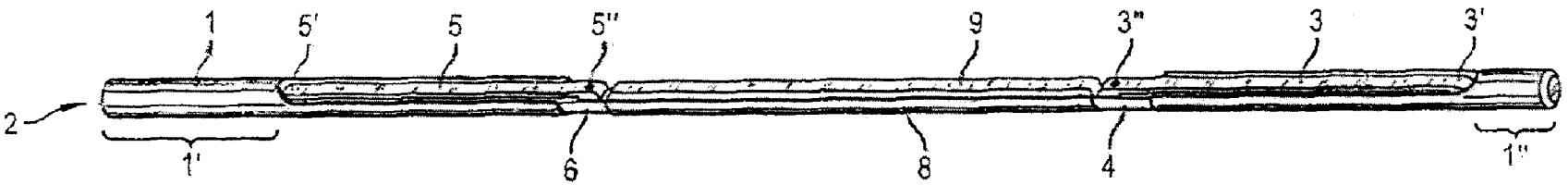

Other aspects, objectives and advantages of this present invention will appear more clearly on reading the following detailed description of one preferred embodiment of the latter, provided by way of a non-limited example and with reference to the appended drawings, in which:

FIG. 1 shows the probe of the invention from a generally sideways viewpoint, FIG. 2 shows the probe of the invention seen from an angle parallel to a longitudinal X axis of the latter, FIG. 3 illustrates one example of the make-up of a container that includes the measuring instruments of the probe, FIG. 4 illustrates one example of the arrangement of geophones and pressure sensors in the container, FIG. 5 is a cross section of the probe when it is in a configuration which allows it to be moved, namely where the anchoring resources are retracted into the main body, FIG. 6A shows, in cross section, a fitting probe according to the invention, FIG. 6B shows part of the fitting probe of FIG. 6A in close-up cross section, in particular a part where it is possible to clearly see the lugs fitting into a guidance head, FIG. 7 is a sketch of a longitudinal section of a well, and the location for anchoring of the preferred probe of the invention, though not drawn to scale, FIG. 8A shows a cross sectional view of the probe in its anchoring position, FIG. 8B shows the probe when the container is retrated into a U-shaped channel.

The probe as proposed by the invention is shown in FIG. 1, from a generally sideways viewpoint, while FIG. 2 shows a view of this probe along an angle parallel to a longitudinal X axis of the probe.

It can be seen here that the longitudinal X axis is a vertical axis when the probe is in its normal position of use, namely in the well.

As can be seen in these figures, the probe includes a central body 1 which is integrally reamed throughout its length on the X axis with an opening 2.

More precisely, the body includes two identical parts 1' and 1" in the form of cylinders opened along their centre along the X axis by the orifice 2.

According to a variant of the invention, the shape of the top end of the central body of the probe can be arranged so as to be able to place this extremity just inside the lower exit of a tube, even when the probe is anchored to a casing.

Between the two identical parts there is a channel 1''' more or less in the form of a U.

At the top of the probe, the inside wall of the main body 1 has a cylindrical recess in which the retention lugs of a fitting tool can be placed.

It can be seen here that according to the invention, it is envisaged in a variant that the probe is designed to be gripped by a coiled tube 60 so that the latter can raise it from the bottom of the well.

To this end, the coiled tube can include the same attachment resources as the fitting probe (these are described below), in particular retention lugs that are capable of being placed into the recess 64 in the cylinder of the main body of the probe.

The probe also has mobile anchoring resources 20, 21 placed laterally of either side of the main body 1 and which lie along the X axis.

It can be seen that FIGS. 1 and 2, in particular, represent the probe in one particular configuration.

In fact, attention is drawn to the fact that the probe is seen here with its anchoring resources 20 and 21 deployed, making it possible to anchor the probe, to a casing for example.

We will see later, with reference to other figures, that the anchoring resources 20 and 21 can also be in a different configuration.

In the method of implementation of the invention, and in the active anchoring configuration presented in particular in FIGS. 1 and 2, the probe therefore has two anchoring resources 20, 21 placed on either side on the X axis.

Each anchoring resource preferably has a pair of elastic blades more or less bowed to the main body 1.

More precisely, a first pair 3, 5 is opposite to the U-shaped channel 1, while a second pair 4, 6 is arranged on the other side of this U channel 1, that is opposite to the rear face of the U-shaped channel 1.

Furthermore, for each pair of blades, one end 3', 4' is mounted to pivot on a sliding element 63 located at the top of the probe in line with the central body, while the other extremity 5', 6' is mounted to pivot on the central body 1 at the bottom of the probe, in such a manner that the pairs too are more or less aligned along the longitudinal X axis.

The two elastic blades 4, 6 are connected at their respective free ends 4", 6" to a half tube 8 located in parallel with the longitudinal X axis of the body 1 and turned toward the latter, and have a certain rigidity in order to constitute, for the probe, a robust lateral contact point against a wall, like that of a casing.

The free ends 3", 5" of the two elastic blades 3, 5, for their part, are connected to a container 9 inside which lies an instrument capable of performing seismic analyses, in particular from recordings of acoustic events.

Concerning the sliding element 63 on which one end 3', 4', 5', 6' of each pair of blades is mounted to pivot, this is incorporated totally into the central body 1 and is able to slide in relation to the latter along the X axis.

Furthermore, this sliding element 63 also includes an orifice passing along the X axis in order to provide continuity of passage between the top and the bottom of the probe with the orifice 2.

Turning now to the container 9, this lies along the X axis between the two elastic blades 3 and 5 and the equipment that it supports is distributed spatially along this axis.

In one preferred method of implementation of the invention, the equipment in particular includes a set of sensors, recording resources 62 such as data memories for example, and measuring resources.

More precisely still, it includes seismic sensors, such as geophones 10 (preferably three), a pressure and temperature sensor 11, an electronic card 12 that includes a processing module with a computing unit, such as a DSP (digital signal processor) for example, which is a processor capable of executing algorithms, in particular to produce results from the measured data, with batteries 12' capable of powering all of the equipment, and a hydrophone 13 (see FIGS. 3 and 4 for this).

It also contains a communication resource 61 which enables the probe to communicate, in particular with the fitting tool, which redirects the communication, where appropriate via an appropriate cable, to the control unit located at the surface.

It can be assumed that the communication resource 61 can also be designed to communicate by means of the coiled tube, equipped for this purpose with a communication resource, such as a communication cable for example.

The use of such a communication tool can be particularly advantageous to allow installation in a horizontal well.

As a communication resource 61, it is possible to use all of the technologies known in this area.

The invention in particular envisages using a communication system based on the use of a connector or a wireless communication system (using a low-frequency or radio signal, an inductive effect, etc.).

FIG. 5 is a representation of the probe when it is in a configuration that allows it to be moved, and therefore not anchored.

In this configuration, the anchoring resources 20, 21 are retracted as far as possible into the central body 1, so that the probe occupies a smaller space at its sides.

In this regard, it is possible to observe, in FIG. 5, that the probe is then arranged in such a manner that it advantageously has a diameter that is more or less equal to the outside diameter of the central body 1.

This is made possible by virtue of the particular shape of the latter, and especially the form of the U-shaped channel 1'''.

Indeed, such a channel 1''' enables part of the passage opening 2, and therefore of the free space thus defined, to serve in particular as a housing for the container supported by the elastic blades 3, 5.

Referring now to FIG. 6, the fitting tool includes a tube 29 in which a motor 30 is installed along the longitudinal X axis, preferably of the direct current type, equipped with a gearing-down unit which, by means of a ball screw 31 guides the displacement of a guidance head 32 along the X axis.

A part of this guidance head 32 is located outside the tube, while the other part is located in the tube 29 attached to the ball screw 31.

The guidance head 32, which is of essentially cylindrical shape, has, on a contour, a discontinuity which is inclined so that the head has a connecting slope 35 along the X axis.

This discontinuity is shaped to constitute a contact point to a top edge of the sliding element 63 of the probe.

The tube 29 is equipped, through a thickness of its lower extremity, with lugs 33, 34 mounted to pivot on an axis orthogonal to the X axis.

These lugs 33, 34 are arranged so that they fit onto the guidance head 32.

In particular, when the head 32 is subjected to a downward movement along the X axis, that is toward the probe, there occurs a moment when its position in the tube is such that the lugs, which were fully incorporated into a thickness of the tube, pivot so that their extremities are caused to move outside the thickness of the tube 29.

One end of these lugs therefore projects from the outside of the tube, and can then be used to constitute a means for attachment of the probe when they are placed into the central body 1 designed for this purpose.

The fitting tool also has a means by which, in particular when it is lowered into a well to retrieve the probe, it can effectively detect when it is alongside the latter.

By way of a non-limited example, this means can be a Hall Effect cell fitted to a magnet installed in an upper part of the central body of the probe.

The fitting tool also has a communication resource that is suitable for communicating with the probe.

Naturally, this communication resource is matched to that of the probe, in particular to ensure that communication can be established at least when the fitting tool is attached to the probe (such as on descent of the probe to the bottom of the well or when rising to the surface or during a calibration process).

By way of a non-limited example, and as mentioned above, the communication resource can be a connector to fit onto that of the probe, or a wireless transceiver.

One application and use of the invention will now be described.

By way of a non-limited example, it is assumed that the probe is located at the top of the well, and that it has to be lowered to the bottom of the latter.

The probe is first attached to the fitting tool, and is placed vertically below the latter.

The fitting tool is suspended vertically from the surface by a cable that has at least one electrical conductor, such as a single-wire cable or a coaxial cable.

As mentioned previously, in addition to the retention function, this cable can be used to communicate with the control unit at the surface, with the fitting tool then acting as a relay between the latter and the probe itself.

The anchoring resources of the probe are retracted into the central body so as to be able to lower it down the well without difficulty.

To this end, the guidance head of the fitting tool is located in a position where the lugs 34, 33 project from the outside so that they are able to take up position in the aforementioned cylindrical recess arranged in the thickness of the main body.

The body of the probe is therefore held vertically by these lugs.

At the same time, the guidance head 32 rests on the said sliding element 63 so that when, by means of the motor and the ball screw, the guidance head slides downwards in the tube, it pushes the said sliding element 63 downward while the central body is held in a fixed position by the lugs.

As a consequence the elastic blades 3, 4 connected to the sliding element 63 are subjected to a force directed downwards, while the blades 5, 6 connected to the central body undergo a traction force upwards.

Because of this, and by virtue of their elasticity, the blades are stretched and adopt a more rectilinear shape while still remaining close to the central body 1.

The probe is therefore lowered to the bottom of the well in this shape configuration.

Remember here that a conventional well 50 generally includes, in longitudinal section, a first casing 40 over a first distance that is less than the depth of the well, a second casing 41 over all of its depth, and a tube 42 that mostly covers the second casing 41 (see FIG. 7).

The well ends with a cement plug 43 preventing the passage of liquid or gas in particular.

As a consequence, according to one preferred method of use of the invention, the probe is installed entirely below the lower part of the tube 42 so that the lateral walls of the second casing 41 are accessible and so that the probe can be anchored there (see FIG. 7).

As mentioned previously, the shape of the top end of the central body of the probe can be arranged, in a variant, so as to be able to place this extremity just in the bottom exit 45 of the tube.

As a consequence, according to this variant, the probe can also be installed essentially below the lower part of the tube 42 but one part, in particular the top end of the central body, remains at the exit of the casing between the walls of the latter.

In this way, with the installed probe remaining aligned with the well, its later retrieval with the fitting tool is facilitated.

In fact the guidance head will easily find the entrance of the orifice 2, and it can enter into this rapidly.

Once positioned, the probe is anchored by moving the guidance head of the fitting probe upwards, namely toward the surface.

This time, the pushing forces of the guidance head on the sliding element, and the traction forces on the central body by the lugs, disappear, or at least reduce.

In particular, the lugs projecting outside the tube are retracted into the thickness of the tube by pivoting, and thus vacate the position provided in the hollow of the central body.

As a consequence, by moving the guidance head upwards, the anchoring resources progressively move back to a bowed rest position, and then exert a considerable force against the wall of the second casing, thus anchoring the probe.

As can be seen, the fitting tool frees the probe, though communication with the latter is not broken.

At this stage, it is already possible to perform functional tests and to effect calibrations.

It is then possible to carry out seismic, temperature and pressure analyses in order, for example, to perform an initial diagnosis on the well and, where appropriate, to adjust the recording parameters by means, for example, of algorithms contained in a memory of the probe.

In this regard, the invention specifies that the algorithms can be modified, at least while communication remains possible with the surface, in particular through the fitting probe.

To this end, it is possible to download a new algorithm with a view to replacing another or to be added to the latter.

This downloading can be effected by means of the communication resources between the probe and the fitting tool (the fitting probe in this example).

Then the fitting probe can be disconnected from the probe and raised to the surface.

Thereafter, other types of analysis can commence.

In particular, seismic analyses can be used to assist with the monitoring of a hydraulic fracturing process, which is familiar as such.

Remember in this regard that in a conventional hydraulic fracturing process, a fluid is injected at high pressure with mineral charges in the well.

There can then exist the formation of an excess of charge, and which needs to be removed generally by means of the coiled tube.

The probe of the invention has the advantage that it does not impede this clearing-out operation in any way, because of its central opening 2.

In fact, for one thing the coiled tube can be inserted freely into it, and secondly, the excess of charge can flow freely in the orifice 2.

As a cleaning resource, it is thus possible to place the coiled tube in the orifice and to inject a liquid such as water in order to force the excess of charge through the orifice 2, and then to the top of the well.

Because of this, not only is the probe no longer blocked by the excess of charge around it, something that would have created difficulties in the case where one might have wanted to retrieve it by means of the fitting tool, but again, its presence at the bottom of the well does not in any way prevent the execution of processes of the hydraulic fracturing type for example.

On the contrary, as mentioned previously, the probe can advantageously constitute a significant asset in the monitoring and control of such an operation.

Firstly, it is capable of recording a hydraulic fracturing cycle.

Then, due to its presence, it is possible to monitor the conditions under which such fracturing is taking place.

In particular, measurements effected by means of the pressure sensor or sensors enable one to determine whether it is opportune to trigger recordings.

By way of example, it is possible to start these recordings by the detection of a simple variation of the bottom pressure in the well at the moment of a fluid injection cycle.

Remember here that the recordings can be checked by the aforementioned algorithms.

In this regard, since these algorithms are modifiable, it is possible to adapt them whenever the probe is connected to the fitting tool, which is at least from the start of the descent into the well and up to the complete installation of the probe.

To this end, it suffices for the operator to transmit to the probe, via the fitting tool, command signals which enable the algorithms to be adapted.

In return, the probe transmits to the control unit, where the operator is located, signals to confirm that the adaptations have been executed successfully.

Furthermore, once installed and abandoned at the bottom of the well, it is also intended that modification of the algorithms can still be implemented by reconnecting the fitting tool.

In this way, it is possible, after obtaining the analysis results for the reservoir for example, to initialise the processing module of the probe, in particular the memories, and to reprogram a different measurement and processing cycle.

Finally, when it is required to raise the probe in the tube, use is preferably made of the fitting probe according to the invention.

The latter is lowered into the well until it grasps the probe.

To this end, the guidance head and the means of detection of the moment of approach facilitate this operation.

And when the fitting probe is correctly positioned in relation to the probe, the motor 30 in particular is activated in order to displace the guidance head in the central body 1 so that the anchoring resources re-enter the latter and the fitting probe is then able to pull the probe to the top of the well.

Naturally, the invention is in no way limited to the description presented above, and the man skilled in the art will understand that many variants are possible.

In particular, the invention does not exclude the use of a standard retrieval tool.

Nevertheless, in this case, it is not possible to retract the anchoring resources into the central body of the probe when one goes to retrieve it at the bottom of the well.

The anchoring resources will remain deployed and in contact with one wall of the well, so that in order to raise the probe in the tube, it will be necessary to apply to the standard retrieval a traction force which is greater than that necessary when using the fitting probe according to the invention.

The invention claimed is:

1. An independent measuring and processing probe designed to be lowered in a tube to be installed temporarily at the bottom of a well, said independent measuring and processing probe including:

deployable anchoring resources capable of anchoring the independent measuring and processing probe to a casing at the bottom of the well, wherein the independent measuring and processing probe has no mechanical link to the surface, a container including a set of sensors, at least one of which iasaid sensors being a seismic sensor, recording resources, and resources for processing measurements provided by the sensors, and a central body having a longitudinal part in a form of a U-shaped channel which extends along a longitudinal axis between two parts, said parts being opened along a center along the axis of said parts by an orifice, said U-shaped channel being shaped to serve as a housing for the container, wherein the anchoring resources comprise two pairs of bowed elastic blades, wherein a first end of one blade of each pair of bowed elastic blades is mounted to a sliding element located at one end of the probe, in line with the central body, a first end of the other blade of each pair of bowed elastic blades is mounted on the central body, at another end of the probe, said sliding element including the orifice passing along the longitudinal axis in order to define a free passage between the top and the bottom of the probe throughout the whole length of the probe, while a second end of both of the elastic blades of one of the pairs of bowed elastic blades is connected to opposite ends of the container so that said container lies along the longitudinal axis between the two elastic blades in front of the U-shaped channel, wherein the sliding element is adapted to slide along the longitudinal axis of the probe between a first position, wherein each blade of each pair of the bowed elastic blades is bowed with respect to the central body when the sliding element is unrestrained, and a second position, wherein each blade of each pair of the bowed elastic blades is stretched and adopts a rectilinear shape and the container is retracted within an empty space of said U-shaped channel, and said parts of the probe and the U-shaped channel define an opening throughout the whole length of the probe.

2. An independent measuring and processing probe according to claim 1, wherein the central body has a hollow so that the independent measuring and processing probe can be temporarily grasped by a fitting tool or a coiled tube.

3. An independent measuring and processing probe according to claim 1, wherein said independent measuring and processing probe also includes a communication resource.

4. An independent measuring and processing probe according to claim 3, wherein the communication resource is suitable for communicating with a fitting tool or a coiled tube.

5. An independent measuring and processing probe according to claim 1, wherein the set of sensors further comprises at least one pressure sensor and at least one temperature sensor.

6. An independent measuring and processing probe according to claim 5, wherein the set of sensors, which is at least designed to be able to execute seismic measurements, selected from the group consisting of geophones, accelerometers and hydrophones.

7. An independent measuring and processing probe according to claim 1, wherein an upper end of the central body is shaped so that said independent measuring and processing probe can be placed in a bottom end of the tube, when the independent measuring and processing probe is anchored to the casing.

8. An independent measuring and processing probe according to claim 1, wherein the recording resources include at least one data memory.

9. An independent measuring and processing probe according to claim 1, wherein the processing resources comprise a digital data processor.

10. An independent measuring and processing probe according to claim 9, wherein a memory contains data relating:

to the measurements coming from the sensors, to algorithms which, together with the processor, are capable of processing the measurements coming from the sensors, and to results obtained after the execution by the processor of at least one of these processes.

11. An independent measuring and processing probe according to claim 10, further comprising communication resources, wherein the communication resources are capable of downloading the algorithms from a fitting tool to the memory of the independent measuring and processing probe.

* * * * *

UNITED STATES PATENT AND TRADEMARK OFFICE

CERTIFICATE OF CORRECTION

PATENT NO. : 8,002,031 B2
APPLICATION NO. : 11/347058
DATED : August 23, 2011
INVENTOR(S) : Thierry De Kimpe et al.

It is certified that error appears in the above-identified patent and that said Letters Patent is hereby corrected as shown below:

Column 9, Claim 1, line 16, delete “which”
Column 9, Claim 1, line 17, delete “iasaid” and insert -- said --

Signed and Sealed this
Sixth Day of March, 2012

David J. Kappos

David J. Kappos
*Director of the United States Patent and Trademark Office*